US006729045B2

(12) United States Patent
Isackson et al.

(10) Patent No.: US 6,729,045 B2
(45) Date of Patent: May 4, 2004

(54) TAP DEVICE FOR CLOGGING SHOES

(76) Inventors: Dale F. Isackson, 568 Old North Shore Rd., Two Harbors, MN (US) 55616; Carl Blanton, 525 Poverty La., Salem, SC (US) 29676

( * ) Notice: Subject to any disclaimer, the term of this patent is extended or adjusted under 35 U.S.C. 154(b) by 0 days.

(21) Appl. No.: 10/262,801

(22) Filed: Oct. 2, 2002

(65) Prior Publication Data

US 2004/0064971 A1 Apr. 8, 2004

(51) Int. Cl.[7] ..... A43B 5/12
(52) U.S. Cl. ..... 36/8.3; 36/113
(58) Field of Search ..... 36/8.3, 113

(56) References Cited

U.S. PATENT DOCUMENTS 2,168,303 A * 8/1939 Sothen ..... 36/8.3
2,739,394 A * 3/1956 Morgan ..... 36/8.3
4,463,506 A * 8/1984 Isackson ..... 36/8.3
4,513,519 A * 4/1985 Hedrick ..... 36/8.3
4,625,436 A * 12/1986 Stevens, Jr. ..... 36/8.3

FOREIGN PATENT DOCUMENTS

GB 2221140 * 1/1990

* cited by examiner

*Primary Examiner*—Ted Kavanaugh
(74) *Attorney, Agent, or Firm*—Paul L. Sjoquist

(57) ABSTRACT

A clogging shoe tap device having a first plate for attachment to a shoe, and a second plate pivotally attached to the first plate along a transverse line of attachment, the second plate also having a transverse balance axis, wherein the transverse line of attachment is offset from the transverse balance axis, causing the tapping edge to hang downwardly when in the rest position.

9 Claims, 1 Drawing Sheet

TAP DEVICE FOR CLOGGING SHOES

BACKGROUND OF THE INVENTION

This invention relates to attachment devices for shoes, to enable the shoes to produce an audible clicking or tapping sound when desired by the wearer. The device is particularly adaptable to a clogging shoe, which is used in a style of country dancing commonly referred to as "clogging." In this dance, the wearer performs a dance step while tapping out a rhythm with the clogging shoes, by raising and lowering the feet to contact the floor. Typically, each clogging shoe is fitted with two devices, one sized to fit over the toe of the shoe and a second device sized to fit over the heel of the shoe, where each device performs a similar function when contacting the floor.

An example of a clogging shoe fitted with devices of the general type described herein can be found with reference to U.S. Pat. No. 4,625,436. The present invention is an improvement over the device described in the patent, as will be found with reference to the drawings, specification and claims contained herein.

SUMMARY OF THE INVENTION

The clogging device of the present invention is constructed of a top plate and a bottom plate, and a pair of fasteners which loosely hold the plates together so as to permit relative pivotal movement to occur between the plates. The top plate is affixed to a shoe and the bottom plate is pivotally affixed to the top plate along a line which is offset from the center of gravity of the bottom plate, so that one end of the bottom plate, which is referred to herein as the "tapping end," normally hangs away from contact with the top plate, until the shoe is brought into contact with the floor.

It is an object of the invention to provide a clogging shoe which produces a uniform sound when brought into contact with the floor, always requiring a uniform force, to provide the sound.

It is another object of the invention to provide a clogging device which can be affixed to the bottom of a shoe and contacted against a floor without causing scratches or damage to the floor.

It is another object of the invention to provide a clogging device for attachment to a shoe which does not have any protruding edges which could injure or trip the wearer.

Other and further objects will become apparent from the following specification and claims, and with reference to the appended drawings.

DESCRIPTION OF THE PREFERRED EMBODIMENT

Figure 1:
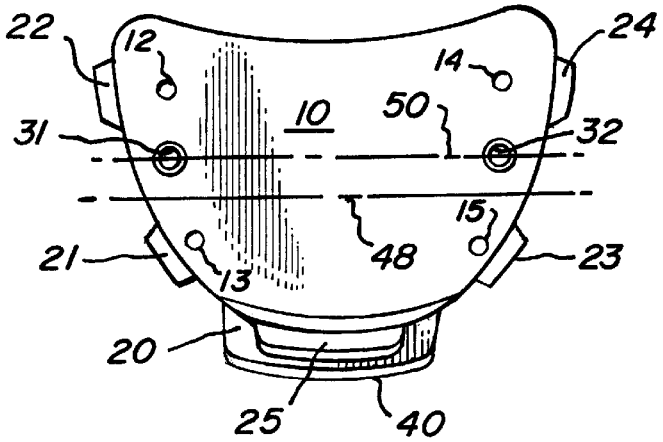
FIG. 1 shows a top view of the invention in assembled form.

Referring first to FIG. 1, the invention is shown in top view. A top plate 10 is adapted for affixing to the bottom of a shoe by means of fasteners passing through the holes 12–15, and anchoring the top plate against the bottom of the shoe. The top plate 10 has upwardly curving tabs 21–24 arranged around the perimeter of the plate, and positioned so as to at least partially embed tabs 21–24 into a shoe sole portion when the top plate 10 is fastened to the shoe. These tabs provide a means for properly securing the top plate against the shoe bottom, and for preventing any lateral movement of the top plate relative to the shoe. The top plate 10 also has a front tab 25 which is upwardly curved for at least partially wrapping around the forward edge of the shoe, for preventing the plate from catching against an external object, such as a floor irregularity.

A bottom plate 20 is attached to plate 10 by two fasteners 31 and 32, preferably rivets which have been loosely fastened between the two plates. The rivets 31 and 32 are fastened through holes aligned along the dotted line 50, which is offset from the center of balance line 40. There preferably is sufficient space between the two plates 10 and 20 to permit separation of the plates while still attached via the rivets, so that the plate 20, which is mounted below the plate 10 in the operational position, pivots downwardly at its end having a front tab 40. This spacing occurs because of the offset of the pivot line 50 rearward from the center of balance line 40.

Figure 2A:
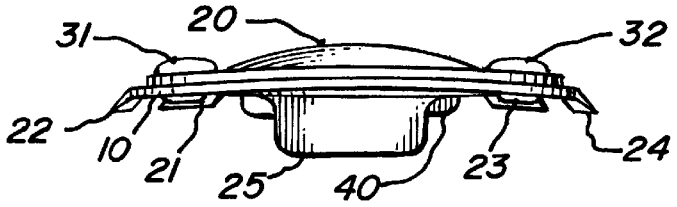
FIG. 2A shows a rear view of the invention with both the top and bottom plates brought into close contact with each other.
Figure 2B:
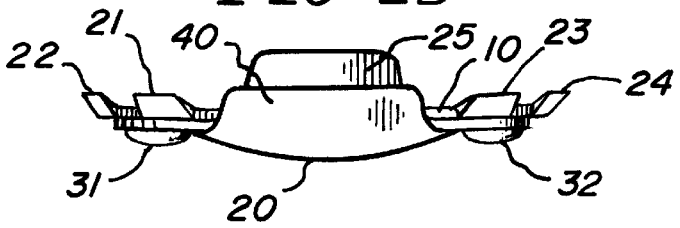
FIG. 2B shows a front view of the invention with both the top and bottom plates brought into close contact with each other.

FIG. 2A shows a rear view of the assembled plates 10 and 20, and FIG. 2B shows a front view of the plates. The front tab 40 of the plate 20 preferably curves upwardly about the front tab 25 of plate 10, making contact with the tab 25 when the plate 20 is pivoted into a striking position. This contact also prevents any excessive rearward shear force against the rivets 31 and 32. The plate 20 has a transverse radius of curvature so that the initial and primary contact with a floor is made along the curved portion of the plate, which prevents catching the plate against any projecting floor object.

Figure 3:
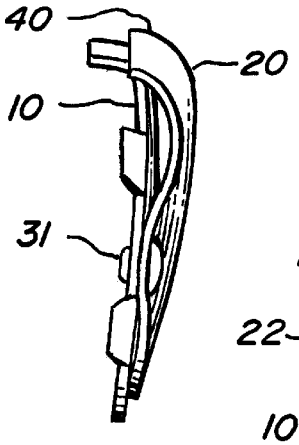
FIG. 3 shows a side view of the invention in the operable position, wherein the bottom plate is separated from the top plate at the tapping end.
Figure 4:
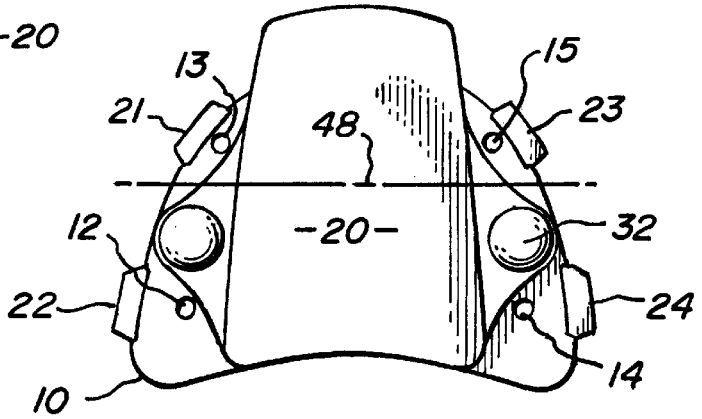
FIG. 4 shows a bottom view of the invention.

FIG. 4 shows a bottom view of the assembled plates 10 and 20, illustration how the plate 20 is shaped about its perimeter to provide access from below to the holes 12–15, so that fasteners such as nails can be affixed through the holes and into a shoe without disassembling the plates 10 and 20. Each of the holes 12–15 is preferably positioned inwardly adjacent one of said tabs 21–24. FIG. 3 shows the plates in a relative operational position, with the front tab portion 40 of plate 20 being spaced away from the front tab portion 25 of plate 10, by pivoting on the rivets 31 and 32. The amount of space between the two plates is determined by the relative fit of the rivets in the plates, and by the rear edge of plate 20 contacting plate 10. At the time the rivets are applied to fasten the plates, they are attached sufficiently loosely to allow for the amount of space shown in FIG. 3. The rivets can be applied according to any known process which achieves the desired spacing. Rivet tools are available which permit adjustment of the crimping distance along the rivet.

In operation, the plates 10 and 20, assembled as shown in the figures are preferably nailed to the bottom toe surface of a dancing shoe. A similar pair of assembled plates are affixed proximate the bottom heel surface of the dancing shoe. Of course, the heel plates are shaped and sized to conform with the shape of the shoe heel area, and the toe plates are shaped and sized to conform with the shape of the shoe toe area. When attached, the front tab portion of plate 20 will drop away from contact with the corresponding tab of the plate 10, until the wearer brings the taps into contact with a floor while executing a dance step. Each time contact with the floor is made, a pleasing tap sound is made which can be used to provide a rhythm beat to match the dance step.

The foregoing description of a preferred embodiment of the invention is intended to be illustrative and not limiting. The true scope of the invention is to be understood and limited by the claims herein, variations in particular details of the invention being entirely possible within the overall scope of the invention as claimed.

What is claimed is:

1. A tap device for attachment to a shoe sole along an edge curvature of said shoe, comprising:

a. a first plate having a curved edge adapted to conform to the edge curvature of said shoe, said plate having a plurality of upwardly depending tabs positioned along said plate curved edge for gripping against said shoe sole; and having a plurality of openings for insertion of fastening devices into said shoe;

b. a second plate having a transverse axis of balance, said second plate being pivotally attached to said first plate along a transverse line offset from said transverse axis of balance; and c. said second plate having an upwardly curved edge extending about a forward one of said first plate depending tabs; said second plate having a shaped perimeter edge to expose said openings in said first plate.

2. The apparatus of claim 1 wherein said second plate further comprises a pair of pivot fastener openings along said transverse line, has a transverse radius of curvature between said pair of pivot fastener openings.

3. The apparatus of claim 2, further comprising a rivet mounted through each of said pivot fastener openings, each said rivet allowing for spatial separation between said first and second plates.

4. The apparatus of claim 3, further comprising a recessed surface area on said second plate about each of said fastener openings, each recessed surface area sized slightly, larger than said respective fastener opening.

5. The apparatus of claim 1, wherein said plurality of openings for insertion of fastening devices are each positioned inwardly adjacent to one of said tabs.

6. A tap device for attachment to a shoe to form a clogging shoe, said tap device comprising:

a. a first plate having openings for accepting fasteners for affixing said first plate to said shoe, and having a curved perimeter edge shaped to conform to an edge of said shoe;

b. a second plate having a first transverse axis defining a balance axis, and having a transverse second pivot axis parallel and offset from said balance axis, and having a pair of spaced apart openings along said second pivot axis, and having a shaped perimeter edge curved to expose said first plate openings for accepting fasteners in said first plate, each of said second plate openings respectively aligned with a first plate opening, and said second plate further comprising a convex radius of curvature along said balance axis, and having respective recessed pockets about said pair of spaced apart openings for receiving a rivet head; and c. a rivet inserted through and affixed to respective pairs of said aligned openings of said first and second plates, said rivet being loosely affixed to said first and second plates, thereby allowing spatial separation between said plates.

7. The apparatus of claim 6, wherein said first plate further comprises a plurality of edge tabs curved upwardly about said curved edge, thereby to wrap about an edge of said shoe.

8. The apparatus of claim 7, wherein said first plate further comprises an upwardly curved toe portion said toe portion wrapping over the toe of said shoe.

9. The apparatus of claim 8, wherein said second plate further comprises an upwardly curved toe portion extending over the edge of said first plate.

* * * * *